United States Patent [19]

Veneziano

[11] 4,034,981

[45] July 12, 1977

[54] TENNIS SERVE TRAINING AID

[76] Inventor: Thomas A. Veneziano, 10100 Westpark Drive, Houston, Tex. 77042

[21] Appl. No.: 706,445

[22] Filed: July 19, 1976

[51] Int. Cl.[2] ..... A63B 69/38

[52] U.S. Cl. ..... 273/29 A; 273/96 R; 124/5

[58] Field of Search ..... 273/29 A, 96 R, 97 R, 273/95 R, 95 A, 67 C, 58 C; 124/5

[56] References Cited

U.S. PATENT DOCUMENTS

| | | | |
|---|---|---|---|
| 1,637,278 | 4/1927 | Renz | 124/5 |
| 2,865,636 | 12/1958 | Blackmun | 273/97 R |
| 3,130,971 | 4/1964 | Boccardi et al. | 124/5 X |
| 3,153,537 | 10/1964 | Lewis | 273/58 C X |
| 3,169,019 | 2/1965 | GenJack | 124/5 X |
| 3,375,604 | 4/1968 | Alonso | 273/97 R X |
| 3,685,827 | 8/1972 | Petrusek | 273/97 R X |
| 3,687,453 | 8/1972 | Fraga | 273/97 R |
| 3,843,126 | 10/1974 | Bandy | 273/95 A |
| 3,936,051 | 2/1976 | Walker, Jr. | 273/95 A |

*Primary Examiner*—Richard C. Pinkham
*Assistant Examiner*—T. Brown
*Attorney, Agent, or Firm*—Bill B. Berryhill

[57] ABSTRACT

A tennis serve training aid comprising: a band adapted to encircle the palm and back of a user's hand; a cup member, the exterior of which may be gripped by the fingers of the user's hand and being adapted to freely receive and release a conventional lawn tennis ball; the cup member being attached to the palm side of the band by a tether.

9 Claims, 2 Drawing Figures

TENNIS SERVE TRAINING AID

BACKGROUND OF THE INVENTION

1. Field of the Invention

The present invention pertains to a training aid for the game of tennis. More specifically, it pertains to a training aid for improving the serving phase of the game of tennis. Still more specifically, it pertains to a training device for improving the serving toss.

2. Brief Description of the Prior Art

One of the greatest problems encountered by students of tennis and amateur tennis players is mastering the tennis serve. To develop a good serve, it is necessary that the tossing of the ball in the air for the serve be properly mastered. One of the major difficulties in learning to properly toss a ball in the air is the proper use and form of the fingers during the toss.

Various training devices have been designed in the past for use with balls of other type games particularly baseball. Examples of such devices may be seen in U.S. Pat. Nos. 3,153,537; 3,169,019; and 3,843,126. However, so far as is known by the present inventor, no one has developed a device suitable for teaching the proper use of the fingers while tossing the tennis ball during the serving phase.

SUMMARY OF THE INVENTION

The tennis serving device of the present invention is primarily to teach or correct the toss of the tennis ball. A proper toss will of course improve the serve.

A proper toss depends to a major extent on the correct use of the fingers during the toss. Many players let their fingers fall across the palm of the hand as soon as the ball is off the end of the fingers rather than keeping the fingers extended upward even after the ball has left the hand. The tennis serving device of the present invention is designed to help the tennis player understand how to open his fingers as the ball is tossed into the air, to keep the fingers open in the proper method, and to guide the ball on a straighter course.

The device may comprise: a band adapted to encircle the palm and back of the player's hand; a cup member, the exterior of which may be gripped by the fingers of the player's hand, the cup member being attached to the palm side of the band by a tether member. The cup member is adapted to freely receive and release a tennis ball. The diameter of the opening of the cup member is preferably less than the major diameter of a tennis ball. The exterior of the cup member which is to be gripped by the fingers may be provided with a non-slipping surface to simulate a tennis ball. Other refinements may be made.

The tennis serving device of the present invention is simple to manufacture and use. It is inexpensive to manufacture and may be sold at a price affordable to all tennis players. Most importantly, it is effective in improving the serving toss of students and beginning players. Even advanced players can improve their toss and serve by use of the device of the present invention. Many other objects and advantages of the invention will be apparent from reading the description which follows in conjunction with the accompanying drawings.

DESCRIPTION OF A PREFERRED EMBODIMENT

Figure 1:
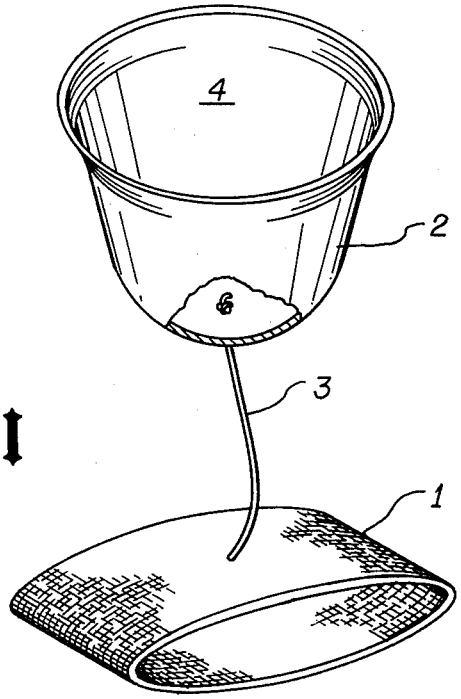
FIG. 1 is a perspective view of the tennis serving device of the present invention.

Referring first to FIG. 1, the tennis serving device of the present invention comprises a band 1 adapted to and encircles the palm and back of the tennis player's hand and a cup member 2 adapted to freely receive and release a tennis ball. The band 1 and cup 2 are attached by a tether member or string 3.

The band 1 is preferably made of an elastic type material such as the knitted materials used for tennis wrist bands. In fact, it may be made from a half-size wrist band. Of course other types of material may be used.

The tether member 3 is attached at one end to the band 1 and at the opposite end to the central bottom of the cup member 2 it may be of an elastic or nonelastic material. A slightly elastic material may be preferable. The length of the tether member 3 must be great enough to allow the cup member 2 to be freely grasped by the fingers, as in FIG. 2, without being held too close to the palm of the user's hand.

The cup member 2 may be of most any shape or form. However, it is desirable if the exterior can be made to simulate the exterior of a tennis ball as much as possible. To further similate a tennis ball, the exterior of the cup member 2 may be provided with a non-slip coating such as rubber or better yet, a coating or covering of tennis ball material. If made with a slight degree of resiliency, the cup member may even closer simulate a tennis ball.

The opening for the cup member is preferably circular in shape. It is also preferable that the diameter of the opening 4 be less than the major diameter of a tennis ball. As can be easily understood, a tennis ball may be freely received by the cup member 2, as in FIG. 2, and freely released from the cup member during the toss.

Figure 2:
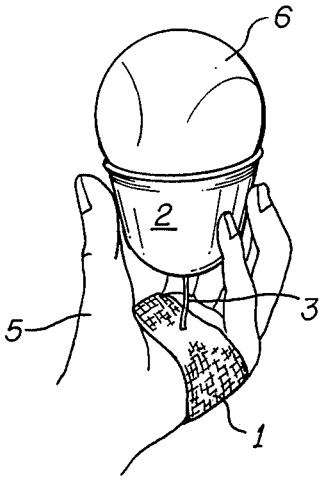
FIG. 2 is a pictorial illustration of the tennis serving device of the present invention properly placed on the tennis player's hand and receiving a tennis ball just prior to the toss.

In use, the band member 1 is slipped over the user's hand 5, as in FIG. 2, between the thumb and fingers with the cup 2 above the palm of the hand. The cup 2 is held by the thumb and fingers as if the player were actually holding a tennis ball.

For initial use, a tennis ball 6 is placed in the cup 2 and the player goes through the toss motion with the palm up and without opening the fingers or releasing the cup member 2. Such motion appears to be awkward at first but once the awkward feeling is overcome, the player is on the way to an improved toss. After this motion is mastered, the same motion with the cup and ball is repeated but now the cup should be released by the fingers. The tether member 3 will prevent the cup from dropping to the ground.

As the toss improves, the player may move his fingers so that they partially grip the cup member 2 and partially the ball 6. As improvement continues, the fingers may be moved progressively to hold more of the ball and less of the cup. Finally, the device can be removed and the player should now have a consistently better toss using only the tennis ball.

From the foregoing description, one can see that the tennis training device of the present invention is simply made and is simple to use. However, its greatest asset is the fact that it actually works. For these reasons, it should find great acceptance in the ever increasing popular sport of tennis.

Although only one embodiment of the invention has been described herein, many variations thereof may be made by those skilled in the art. Therefore, it is intended that the scope of the invention be limited only by the claims which follow.

I claim:

1. A tennis serving device comprising:

a band adapted to encircle the palm and back of a user's hand;

a cup member the exterior of which may be gripped by the fingers of said user's hand, said cup member being adapted to freely receive and release a conventional lawn tennis ball;

said cup member being attached to the palm side of said band by tether means.

2. The tennis serving device of claim 1 in which the diameter of the opening of said cup member is less than the major diameter of said tennis ball.

3. The tennis serving device of claim 2 in which the exterior of said cup member which is to be gripped by the fingers is provided with a non-slipping surface to simulate a conventional lawn tennis ball.

4. The tennis serving device of claim 2 in which said cup member is designed to provide a degree of resiliency similar to the resiliency of said tennis ball.

5. The tennis serving device of claim 1 in which said band is elastic, permitting said band to be slipped around the fingers but to tightly grip said palm and back of hand.

6. The tennis serving device of claim 1 in which said tether means comprises an elastic string.

7. A tennis serving device comprising:

an attachment member for attaching the device at the palm of a user's hand;

a cup member having an opening adapted to freely receive and release a tennis ball, said opening having a diameter no greater than the major diameter of a conventional lawn tennis ball, the exterior of said cup member being positionable for gripping by the fingers of said user's hand; and a tether member connected at one end to said attachment member and at the opposite end to the bottom of said cup member, the length of said tether member being great enough to allow said gripping of said cup member exterior with the fingers fully extended.

8. The tennis serving device of claim 7 in which said attachment member comprises an elastic band adapted to encircle the palm and back of said user's hand.

9. The tennis serving device of claim 8 in which the exterior of said cup member which is to be gripped by said fingers is provided with a conventional lawn tennis ball-like surface.

* * * * *